US008661719B2

(12) United States Patent
Hughes et al.

(10) Patent No.: US 8,661,719 B2
(45) Date of Patent: Mar. 4, 2014

(54) INTERACTIVE GREETING CARD WITH MAGNET

(71) Applicant: American Greetings Corporation, Cleveland, OH (US)

(72) Inventors: Terry Hughes, Avon, OH (US); Carol Miller, Twinsburg, OH (US); John Talbot, Bay Village, OH (US); Gary Nelson, Avon, OH (US); Lauren Budzar, Seven Hills, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/798,260

(22) Filed: Mar. 13, 2013

(65) Prior Publication Data

US 2013/0255115 A1 Oct. 3, 2013

Related U.S. Application Data

(60) Provisional application No. 61/619,643, filed on Apr. 3, 2012.

(51) Int. Cl.
*G09F 1/00* (2006.01)
*G09F 1/04* (2006.01)

(52) U.S. Cl.
CPC ..... *G09F 1/04* (2013.01)
USPC ..... 40/124.04; 40/124.03; 40/124.02

(58) Field of Classification Search
USPC ..... 40/124.02, 124.03, 124.04; 335/205–208
See application file for complete search history.

(56) References Cited

U.S. PATENT DOCUMENTS

| | | | | |
|---|---|---|---|---|
| 8,106,733 | B2 * | 1/2012 | Nakasuji et al. | 335/205 |
| 8,576,031 | B2 * | 11/2013 | Lauder et al. | 335/219 |
| 2009/0036020 | A1 * | 2/2009 | Nelson et al. | 446/297 |
| 2009/0220928 | A1 * | 9/2009 | Chen et al. | 434/317 |
| 2013/0000164 | A1 * | 1/2013 | Shah et al. | 40/124.02 |
| 2013/0074380 | A1 * | 3/2013 | Mayer et al. | 40/124.03 |

* cited by examiner

*Primary Examiner* — Joanne Silbermann
*Assistant Examiner* — Christopher E Veraa
(74) *Attorney, Agent, or Firm* — Christine Flanagan

(57) ABSTRACT

The interactive greeting card of the present invention contains a multi-panel greeting card body with various electronic components contained and concealed therein. Upon opening the greeting card, spoken instructions may instruct the user to move an attached magnet from one area of the greeting card to another to initiate a surprise or various special effects such as sound and light.

20 Claims, 3 Drawing Sheets

INTERACTIVE GREETING CARD WITH MAGNET

RELATED APPLICATIONS

This application claims priority to U.S. Provisional Patent Application No. 61/619,643, filed on Apr. 3, 2012, a copy of which is incorporated herein by reference in its entirety.

FIELD OF THE INVENTION

The present invention is in the field of social expression products, and more specifically directed to an interactive greeting card.

SUMMARY OF THE INVENTION

The interactive greeting card of the present invention contains a multi-panel greeting card body with various electronic components contained and concealed therein. Upon opening the greeting card, spoken instructions may instruct the user to move an attached magnet from one area of the greeting card to another to initiate a surprise or various special effects such as sound and light.

DETAILED DESCRIPTION OF PREFERRED AND ALTERNATE EMBODIMENTS

Figure 1:
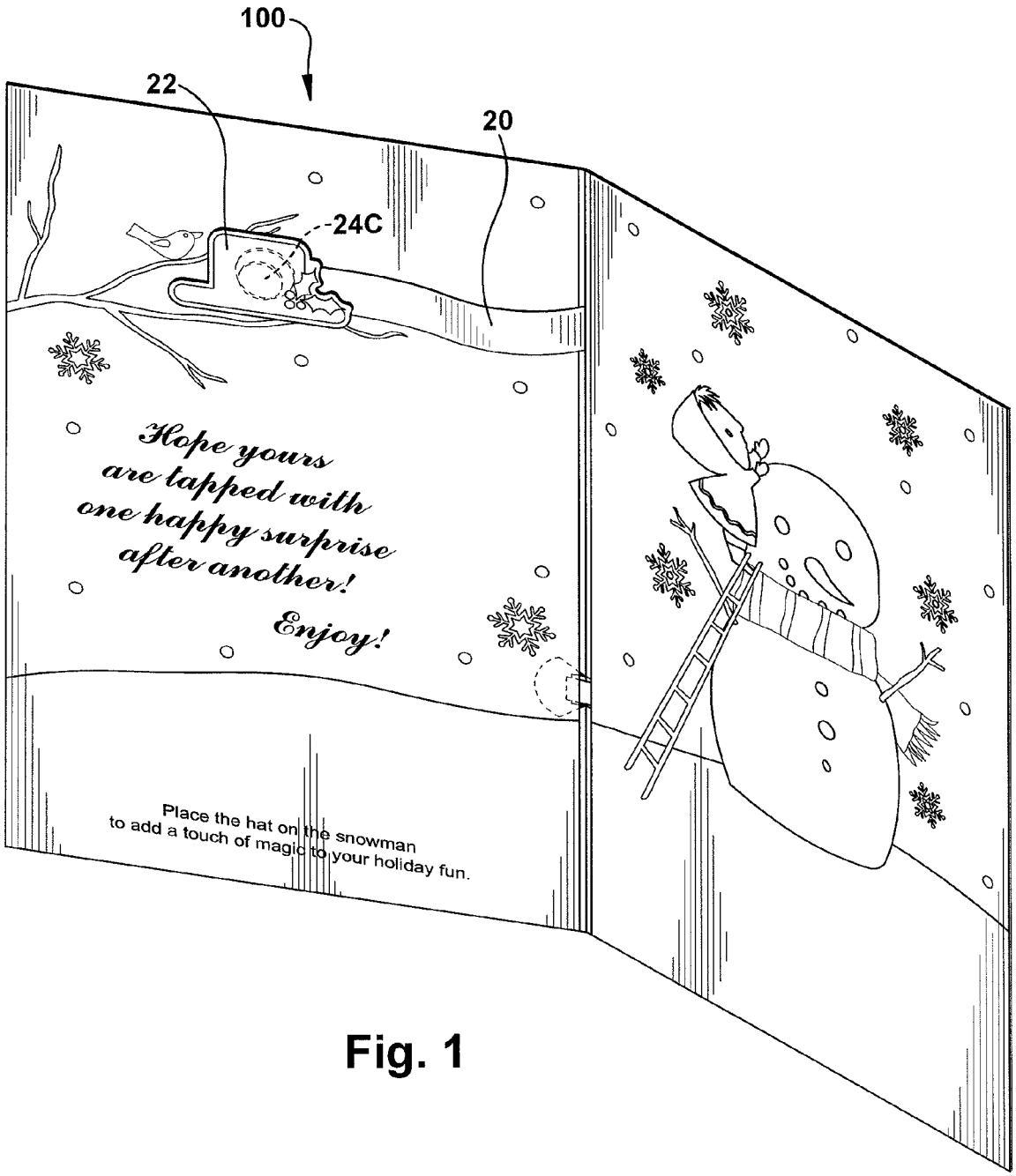
FIG. 1 is a perspective view of the greeting card of the present invention, with magnet in a first position.
Figure 2:
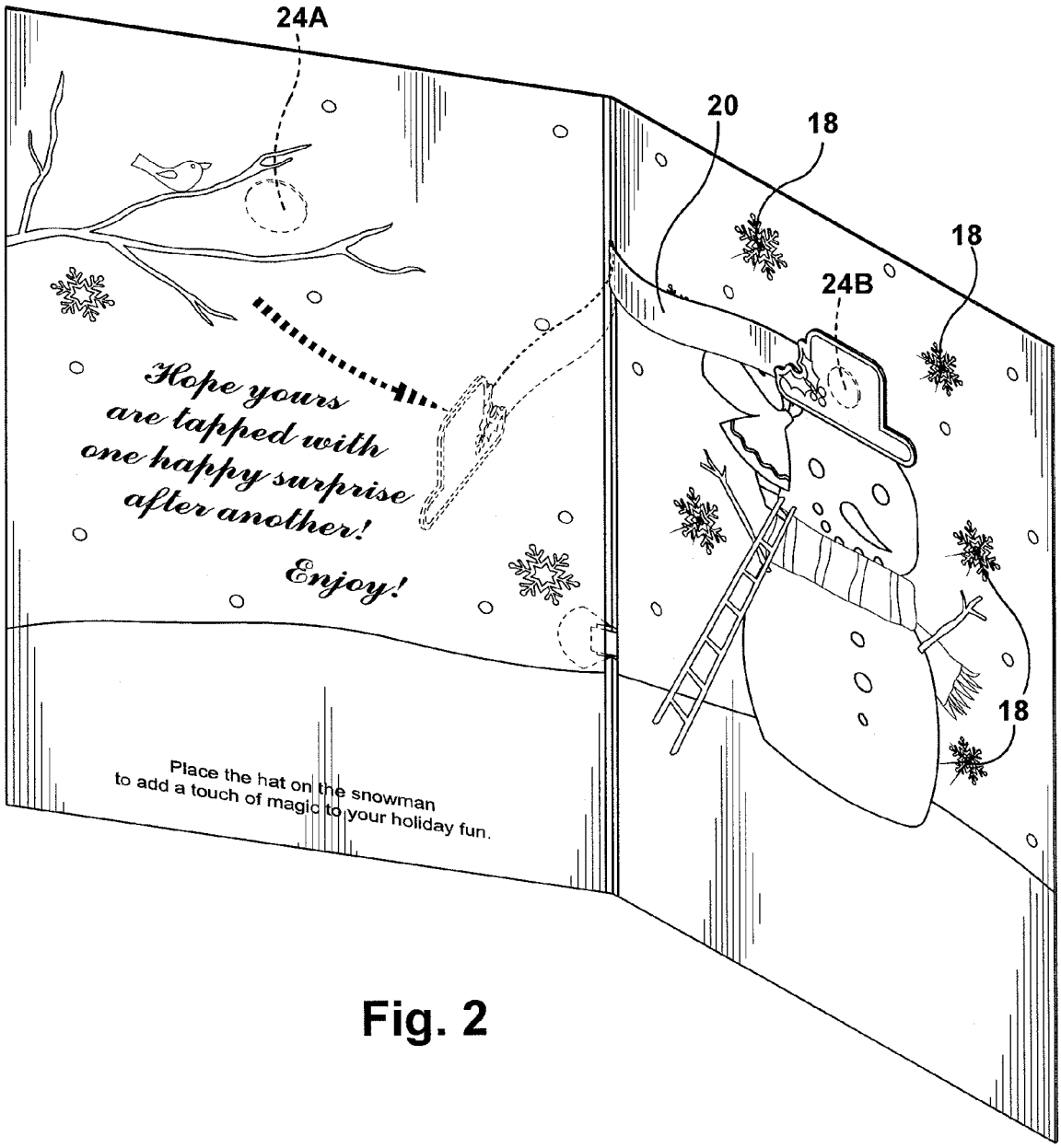
FIG. 2 is a perspective view of the greeting card of FIG. 1, with magnet in a second position.
Figure 3:
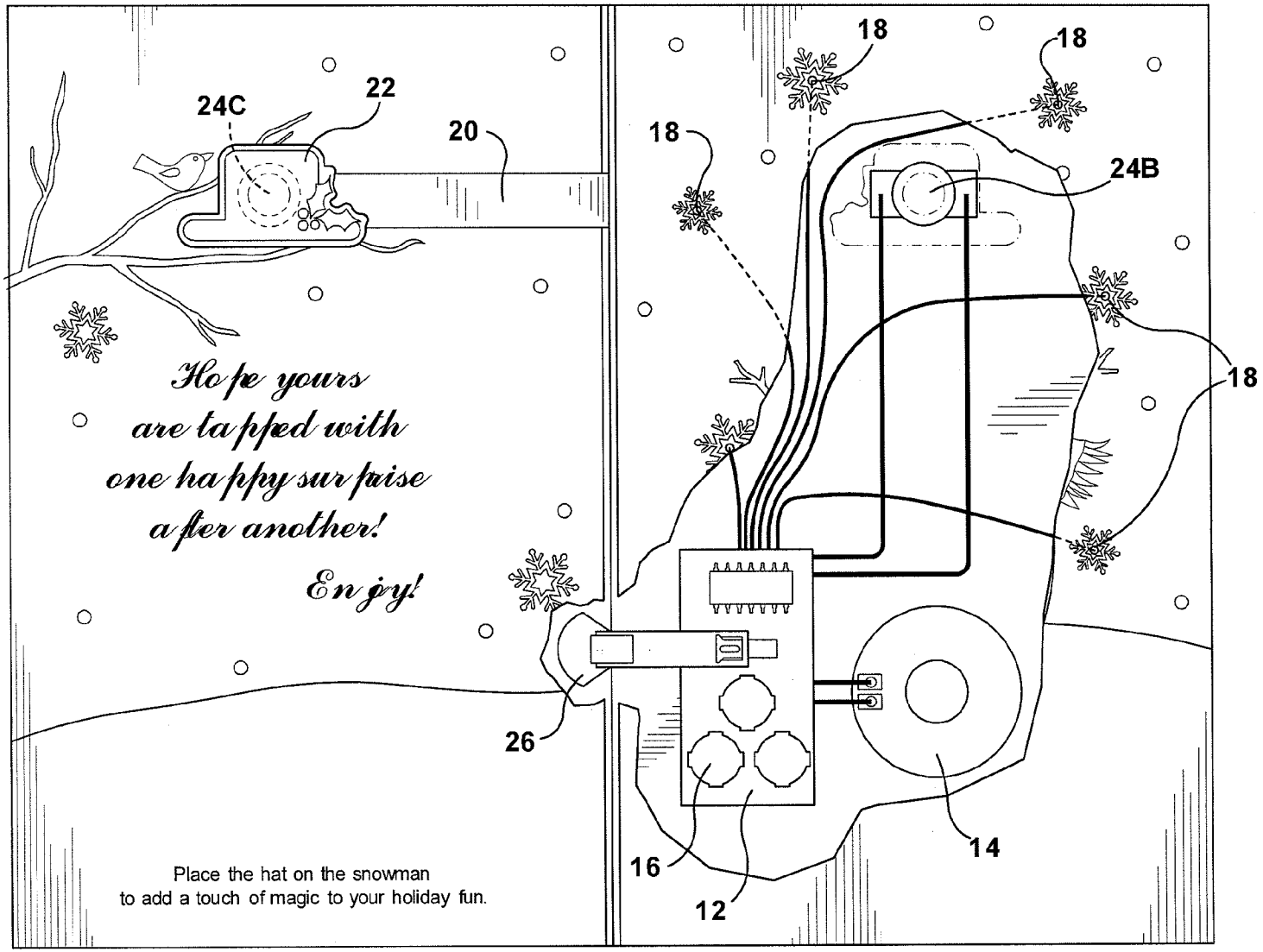
FIG. 3 is a front tear-away view of the inside of the greeting card of FIG. 1.

The interactive greeting card of the present invention includes a multi-panel greeting card body having various electronic components concealed and contained between the various panels of the greeting card and at least one magnetic trigger or switch which controls playback of at least one pre-recorded digital audio file.

In a preferred embodiment, the greeting card body contains a first greeting card panel attached to a second greeting card panel along a first fold line, the second greeting card panel attached to a third greeting card panel along a second fold line, and the third greeting card panel attached to a fourth greeting card panel along a third fold line. The first and second greeting card panels are attached thereby creating a first cavity therebetween, the first and second greeting card serving as the greeting card cover panel. The third and fourth greeting card panels are attached thereby creating a second cavity therebetween, the third and fourth greeting card panels serving as the greeting card back panel. The greeting card is opened and closed by pivoting the front panel about the second fold line.

The electronic components of the greeting card contain a sound module which includes any components, as known to one with skill in the art, required to store, trigger and playback at least one pre-recorded digital audio file. Some of these components may include, but are not limited to: a printed circuit board 12, an integrated circuit, a memory device, a speaker 14, a power source 16 such as one or more button cell batteries and at least one switch. In addition to the sound module, the greeting card 100 may also contain additional components required to initiate other special effects such as lights or motor movement. One or more LED lights 18 may be placed between one of the cavities in the greeting card 100 and made visible through small apertures or holes in one or more greeting card panel. A first magnet 24A is placed with the first cavity and a second magnet 24B is placed within the second cavity, both magnets being located at an opposite but corresponding location (same vertical elevation). A small strip of plastic 20 or other transparent material is attached at one end to the center of the greeting card or second fold line between the front and back covers of the greeting card 100. The plastic strip 20 is attached at the opposite end to a decorative element 22 which contains a third magnet 24C, which is contained and concealed therein the decorative element 22. The length of the plastic strip 20 extends just far enough so that the decorative element 22 with magnet 24C lines up directly with the first 24A and second 24B magnets concealed within the two greeting card cavities. The second magnet 24B is a magnetic trigger which is operative to trigger playback of at least one digital audio file and also to activate the one or more lights 18 contained within the greeting card 100, when the second magnet 24B is in contact with the third magnet 24C. The first magnet 24A contains a higher magnetic field such that the third magnet 24C stays attached to the first magnet 24A when the greeting card 100 is in a closed or folded position. When the decorative element 22 containing the third magnet 24C is moved from the first magnet 24A to the second magnet 24B, activation of the audio and lights is initiated. The decorative element 22 is preferably a die cut shape made from greeting card material such as paperboard, but can be any other type of decorative element or embellishment made into any shape or form.

In a preferred embodiment, a slide switch mechanism 26 is placed over the second fold line between the front and back cover of the greeting card 100 such that when the greeting card 100 is opened the slide switch 26 triggers activation of a first digital audio recording. This audio recording may be a recorded spoken instruction instructing the user how to initiate the audio and visual special effects. Instructions may also be printed on one of the inside panels of the greeting card 100 as well. As an example, the greeting card 100 shown and described herein contains a picture or drawing of a snowman on the inside right panel of the greeting card (fourth panel). Other artwork and written text may appear on any or all panels of the greeting card. Various apertures or openings which reveal small LED lights 18 are located around the snowman on the inside right panel of the greeting card. The decorative element 22 attached to the plastic strip 20 and containing the third magnet 24C is a die cut piece shaped like a top hat. When the slide switch 26 activates a first digital audio recording, spoken instructions tell the user to "place the hat on the snowman" to initiate a surprise. When the user moves the top hat away from the first panel (where it is attached to the first magnet 24A) to the second panel (containing the second magnet 24B), it appears as though the hat is sitting atop the head of the snowman and the magnetic trigger 24C initiates another digital audio recording, which may be a song, musical arrangement, spoken verse, sound or any other recorded audio and also initiates activation of the various LED lights 18. The lights 18 may be programmed to twinkle, blink or follow any other pattern which may be in sync with the accompanying audio. When the greeting card 100 is closed, the third magnet 24C re-attaches to the first magnet 24A, which contains the greater magnetic field and the sound and lights are deactivated. Re-attracting the third magnet 24C back to the first magnet 24A upon closing the greeting card 100 returns the magnet configuration back to the initial state so that the next person opening the greeting card 100 may interact with the greeting card 100 in accordance with the original operation of the card, as described above. Each time the greeting card 100 is closed the magnets are set back to the initial state so that the greeting card 100 works the same way each time the greeting card 100 is re-opened.

While the preferred embodiment is described as having a snowman and top hat various other themes or decorative effects may be used such as placing a crown on a princess, placing a candle on a cupcake, or any other such themes. Also the greeting card body may contain any number of greeting card panels and is not limited to the four panels that have been described herein with respect to the preferred embodiment. Various other special effects may be used in addition to or in place of the flashing lights, such as motorized moving components or any other such special effects.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive greeting card comprising:

a multi-panel greeting card body;

a electronics module operative to store and playback one or more digital audio recordings and to activate one or more LED lights;

a first magnet contained within the greeting card body;

a second magnet contained within the greeting card body, the second magnet being part of a magnetic switch;

a third magnet which may be moved from a first position where it is attached to the first magnet and a second position where it is attached to the second magnet;

wherein when the third magnet is in the second position, the magnetic switch triggers the electronics module to playback the one or more digital audio recordings and to activate one or more LED lights.

2. The interactive greeting card of claim 1, wherein the third magnet is concealed within a die cut object.

3. The interactive greeting card of claim 2, wherein the die cut object is connected to the greeting card via a transparent strip.

4. The interactive greeting card of claim 2, wherein the die cut object, when placed into the second position, completes a picture printed on the greeting card body.

5. The interactive greeting card of claim 1, wherein the first magnet is concealed between two greeting card panels which make up the cover or front panel of the greeting card.

6. The interactive greeting card of claim 1, wherein the second magnet is concealed between two greeting card panels which make up the back panel of the greeting card.

7. The interactive greeting card of claim 1, wherein the first, second and third magnets are positioned in approximately the same vertical position within the greeting card.

8. An interactive greeting card comprising:

a front cover comprising a first panel connected to a second panel;

a back cover comprising a third panel connected to a fourth panel, the front and back covers being connected along a fold line;

a first magnet contained and concealed within the front cover;

a second magnet contained and concealed within the back cover, the second magnet being part of a magnetic switch;

a third magnet contained within a die cut object;

wherein when the greeting card is opened, the third magnet is attached to the first magnet and removing the third magnet from the first magnet to the second magnet triggers the magnetic switch to causes one or more LED lights contained within the greeting card to light up.

9. The interactive greeting card of claim 8 further comprising a sound module.

10. The interactive greeting card of claim 9, wherein when the sound module initiates playback of a pre-recorded digital audio file when the third magnet is attached to the second magnet.

11. The interactive greeting card of claim 8, wherein the one or more LED lights are contained within the back cover and are visible through one or more openings within the back cover.

12. The interactive greeting card of claim 8, wherein closing the greeting card causes the third magnet to detach from the second magnet and re-attach to the third magnet.

13. The interactive greeting card of claim 9, wherein when the greeting card is opened, the sound module initiates playback of an audio file.

14. The interactive greeting card of claim 13, wherein the audio file contains verbal directions instructing the user to move the third magnet from the first magnet to the second magnet to hear another audio message or song.

15. An interactive greeting card comprising:

a first panel attached to a second panel creating a cavity therebetween;

a third panel attached to a fourth panel creating a cavity therebetween;

the second panel attached to the third panel along a fold line;

a first magnet contained within the cavity between the first and second panels;

a second magnet contained within the cavity between the third and fourth panels, the second magnet being part of a magnetic switch;

a sound module operative to store and playback at least one audio clip;

one or more LED lights contained within the greeting card and visible through one or more openings in the first, second, third or fourth panels;

a third magnet located between the first and second and the third and fourth panels and attached to the greeting card via an attachment mechanism;

wherein moving the third magnet from being attached to the first magnet to being attached to the second magnet triggers the magnetic switch to initiates playback of the at least one audio clip and causes illumination of the one or more LED lights.

16. The interactive greeting card of claim 15, wherein the LED lights are contained within the cavity created by the third and fourth panels.

17. The interactive greeting card of claim 15, wherein the one or more openings are located on the fourth panel.

18. The interactive greeting card of claim 15, wherein the third magnet is contained and concealed within a die cut object.

19. The interactive greeting card of claim 15, wherein closing the greeting card causes the third magnet to detach from the second magnet and reattach to the first magnet.

20. The interactive greeting card of claim 19, wherein the die cut object appears to be a part of the drawing when the third magnet is attached to the second magnet.

* * * * *